US006877263B2

(12) United States Patent
Clark

(10) Patent No.: US 6,877,263 B2
(45) **Date of Patent: *Apr. 12, 2005**

(54) MESSAGE CARD WITH TRANSACTION CARD HOLDER

(75) Inventor: Elyse Clark, Newtown, CT (US)

(73) Assignee: Kool Wraps, L.L.C., Newtown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/357,519

(22) Filed: Feb. 4, 2003

(65) Prior Publication Data

US 2004/0093773 A1 May 20, 2004

Related U.S. Application Data

(63) Continuation-in-part of application No. 10/293,476, filed on Nov. 14, 2002.

(51) Int. Cl.[7] ..... B65D 85/57

(52) U.S. Cl. ..... 40/124.06; 40/124.19; 206/308.1

(58) Field of Search ..... 40/124.06, 124.09, 40/124.19; 206/308.1

(56) References Cited

U.S. PATENT DOCUMENTS

| | | | | |
|---|---|---|---|---|
| 1,855,822 A | | 4/1932 | Cahn | |
| 2,131,448 A | | 9/1938 | Lowen | |
| 2,367,967 A | | 1/1945 | Schwartz | |
| 2,417,982 A | | 3/1947 | Histed | |
| 2,749,657 A | | 6/1956 | Lohnes | |
| 3,191,328 A | | 6/1965 | Lohnes | |
| 3,225,474 A | | 12/1965 | Dusseau | |
| 3,353,657 A | | 11/1967 | Young | |
| 3,855,726 A | | 12/1974 | Yumoto | |
| 3,900,100 A | | 8/1975 | Girman | |
| 3,946,936 A | | 3/1976 | Brown | |
| 4,103,444 A | | 8/1978 | Jones et al. | |
| 4,313,270 A | | 2/1982 | Volkert et al. | |
| 4,360,106 A | | 11/1982 | Irvine et al. | |
| 5,004,271 A | | 4/1991 | Piatt | |
| 5,096,055 A | | 3/1992 | Opper | |
| 5,141,252 A | | 8/1992 | Michlin | |
| 5,450,680 A | | 9/1995 | Bromberg | |
| 5,692,671 A | * | 12/1997 | Mussier et al. | 229/117.14 |
| 5,799,424 A | | 9/1998 | Volkert et al. | |
| 5,884,770 A | | 3/1999 | Galm | |
| 5,933,989 A | | 8/1999 | Volkert et al. | |
| 5,943,800 A | | 8/1999 | Rose | |
| 5,947,281 A | | 9/1999 | Kaneff | |
| 5,971,157 A | * | 10/1999 | Howell et al. | 206/755 |
| 6,241,086 B1 | | 6/2001 | Bergh et al. | |
| 6,301,813 B1 | | 10/2001 | Volkert | |
| 6,446,800 B1 | | 9/2002 | Bergh et al. | |
| 6,491,160 B1 | | 12/2002 | Butler et al. | |
| 6,493,970 B1 | | 12/2002 | McCarthy et al. | |
| 6,505,737 B1 | | 1/2003 | Sherman | |
| 6,588,658 B1 | * | 7/2003 | Blank | 235/380 |

FOREIGN PATENT DOCUMENTS

| | | |
|---|---|---|
| IT | 458834 | 8/1950 |

* cited by examiner

*Primary Examiner*—Cassandra H. Davis
(74) *Attorney, Agent, or Firm*—Dickstein Shapiro Morin & Oshinsky LLP

(57) ABSTRACT

An integrated message card and transaction card holder includes a message card such as a greeting card or promotional brochure, and a holder for a securing a transaction card. The message card includes a cover portion which partially covers a transaction card placed in the holder, so that the transaction card is movable between a first position relative to the cover portion when the message card is in a closed state, and a second position relative to the cover portion when the message card is in an opened state.

28 Claims, 7 Drawing Sheets

MESSAGE CARD WITH TRANSACTION CARD HOLDER

The present application is a continuation-in-part of U.S. patent application Ser. No. 10/293,476, entitled GREETING CARD WITH GIFT CARD HOLDER, filed Nov. 14, 2002, the entire disclosure of which is hereby incorporated by reference.

FIELD OF THE INVENTION

The present invention is directed to a message card having an integrated holder for presenting a transaction card upon opening the message card.

BACKGROUND OF THE INVENTION

Gift certificates to various stores or restaurants are a popular gift idea for birthdays or the holidays. They allow the sender to give a gift from a store at which the sender knows the recipient enjoys shopping, while relieving the sender of the burden of selecting a specific item of the right size or according to the tastes of the recipient. A gift certificate to a restaurant enables the recipient to enjoy a meal at the selected restaurant with whomever the recipient chooses. Gift certificates may be purchased in incremental amounts as determined by the vendor, or in any amount desired by the purchaser.

In the prior art, gift certificates were essentially a paper-based, printed IOU issued by the store, and coming in a variety of different shapes and sizes, according to the preferences of the vendor. Typically, the gift certificate was presented to the recipient in a matching envelope from the vendor, along with a greeting card appropriate for the occasion as selected by the sender.

Recently, the gift certificates issued by many retailers, merchants, service providers, etc. have evolved into a form similar to debit cards, having a magnetic stripe, bar code, or other read/write capability. The new generation of gift certificates are more uniformly sized and shaped similarly to credit/debit cards and are "refillable," so as to be reusable by the recipient as an access card for a pre-paid, declining balance-type account. Moreover, the capability to automatically update the value of the card enables the vendor to avoid having to issue a new or replacement certificate, or to cash out any remainder if the recipient does not use the whole amount at once.

SUMMARY OF THE INVENTION

The present invention provides a message card which includes a first leaf hingedly connected to a second leaf so as to be openable and closable like a book or in a flip-top manner. The message card includes a transaction card holder, preferably sized to hold a credit card sized or similarly sized card, and a cover which covers a portion of the transaction card holder. The transaction card holder is movable between a first position relative to the cover when the message card is in a closed state, and,a second position relative to the cover when the message card is in an opened state. When a transaction card is placed in the transaction card holder, at least a substantial portion of the transaction card is displayed to a recipient from behind the cover when the message card is opened.

In a first preferred application of the invention, the message card is a greeting card containing a message suitable for a particular holiday, event or situation, and the transaction card holder may be used to present a gift card to a recipient in a convenient, efficient, and attractive manner. The greeting card with integrated gift card holder thus eliminates the need to obtain and present the recipient with both a greeting card and also a separate envelope or other holder or container for a gift card.

In a second preferred application of the invention, the message card is a promotional item such as a brochure, advertisement, flyer, etc. containing information regarding a product, service, merchant, brand, restaurant, etc., while the transaction card which may be inserted into the transaction card holder may provide temporary free access or use or a discount for the product, service, merchant, restaurant, brand, etc. being promoted. The provider of the subject matter being promoted may display a plurality of the promotional items for free distribution to potential consumers at public locations, or distribute them through other means, such as through the U.S. Postal Service.

Other features and advantages of the present invention will become apparent from the following description of the invention which refers to the accompanying drawings.

DETAILED DESCRIPTION OF PREFERRED EMBODIMENTS

Figure 1:
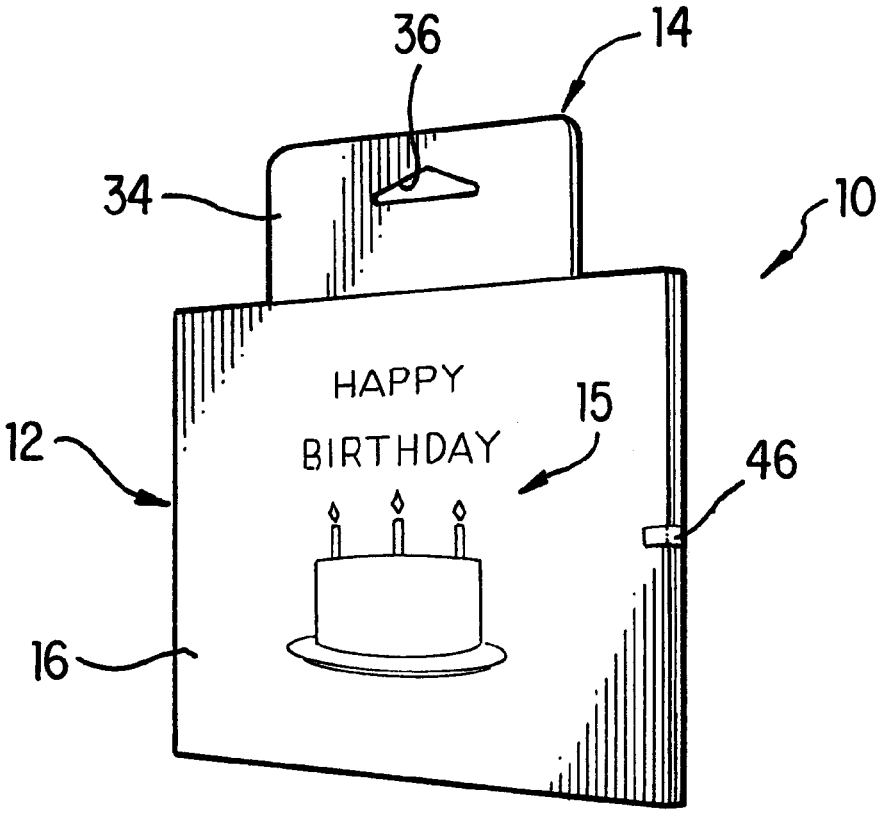
FIG. 1 illustrates an embodiment of the present invention as it may appear in a retail display, showing a closed message card attached to a hangar unit for being hung from a display rack.
Figure 2:
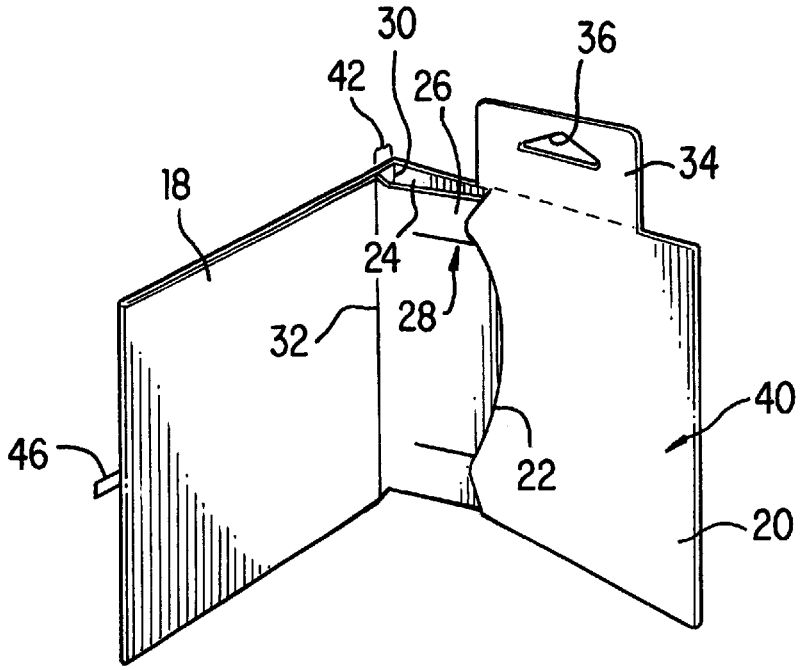
FIG. 2 illustrates the message card of FIG. 1 in a partially opened state.

FIG. 1 shows an exemplary embodiment of an integrated message card and transaction card holder 10 in accordance with the present invention. As seen in FIG. 1, the integrated card 10 includes a message card portion 12 and an optional hangar portion 14. Message card portion 12 includes a front panel 16, which is provided with words, images, and/or patterns, etc. The message content 15 may contain words or images appropriate for a greeting card to acknowledge a particular holiday, situation or occasion, i.e., birthday, Christmas, Hanukah, thank you, congratulations, graduation, wedding, new baby, etc. Alternatively, the message content 115 may include commercial or advertising content for promoting a product, service, restaurant, store, brand, etc. As seen in FIG. 2, front panel 16 is connected to rear panel 24 along central fold line 30. Rear panel 24 may optionally also contain printed matter, such as may be found in standard greeting cards, or additional information or directions for using the transaction card (described below), product, service, or brand being promoted by the message card.

Figure 3:
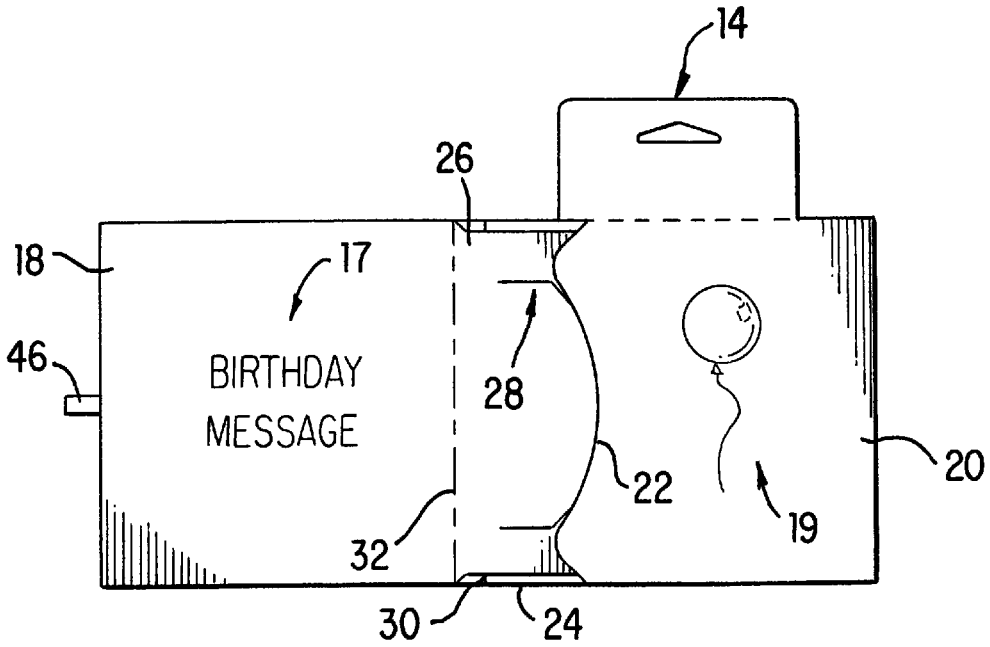
FIG. 3 illustrates the message card of FIG. 1 in a fully opened state.

Inside left panel 18, shown in FIGS. 2 and 3, is aligned with front panel 16 and forms the rear surface of front panel 16 and is visible when message card 12 is opened. Inside left panel 18 may also contain additional printed text, images, patterns, etc. 17, as determined by the theme of the message card content. Opposite the inside left panel 18 is a pocket 40 formed by inside right panel 20 and rear panel 24. Inside right panel 20 is aligned over rear panel 24 at their respective right edges, as seen in the drawings, and has a left edge 22 significantly short of reaching center fold line 32, to allow room for presentation of a transaction card between the left edge 22 of inside right panel 20 and the central fold line 30, as will be described further below. As with inside left panel 18, inside right panel 20 may also contain text, images, patterns, etc. 19 related to the message content 15 provided on the front panel 16. When the message card is embodied as a greeting card, sufficient blank space is preferably provided on inside left panel 18 and/or inside right panel 20 for a handwritten salutation or message from the sender to the recipient.

In this exemplary embodiment, hangar 14 is attached to inside right panel 20 along the top edge thereof Hangar 14 includes a tab portion 34 with a cutout hole 36 formed therein for hanging the message card on a display rack at the retail or vendor location, and may be detachable from message card 12 by tearing along perforated line 38 die cut along the top edge of inside right panel 20. A removable hangar 14 is preferably provided when message card 12 is a greeting card, so that a consumer/sender of the card can remove the hangar 14 after purchase of the card 12 and before giving the card 12 to a recipient. Optionally however, hangar 14 may be omitted entirely from the integrated card and holder 10.

A transaction card panel 26 is connected to inside left panel 18 along interior fold line 32, and is cut away slightly along its top and bottom edges so that transaction card panel 26 has a smaller height dimension than that of the inside left panel 18, front panel 16, rear panel 24 and inside right panel 20. The reduced height of transaction card panel 26 allows it to easily fit into and slide in and out of pocket 40. Similarly with the other panels, transaction card panel 26 may contain decorative or informative print, especially on the portion thereof which remains exposed when the message card 12 is opened. Transaction card panel 26 includes a transaction card holder 28, which in this embodiment is formed by a pair of slits cut into transaction card panel 26. As can be seen more clearly in FIGS. 6 and 11, the slits are cut in a manner such that a transaction card 44 can be inserted into the slits without slipping through and falling completely behind transaction card panel 26.

The interior fold line 32 connecting transaction card panel 26 to inside left panel 18 is offset from the central fold line 30 toward the left edge of inside left panel 18. With this configuration, when a transaction card 44 is inserted into the holder 28 of the transaction card panel 26, most of the transaction card 44 will be inserted behind edge 22 and into the pocket 40 when the message card 12 is closed. Furthermore, as can be seen in FIGS. 2 and 4 showing the message card 12 in a partially opened state, a gap is formed between rear panel 24 and transaction card panel 26 due to the offset distance 42 along front panel 16 between center fold line 30 and interior fold line 32.

Optionally, an adhesive strip 46 may be provided for holding the message card 12 closed. Other materials or mechanisms may alternatively be used to maintain closure of the message card 12 until desired to be opened. Examples include any of various types of light, resealable and/or removable adhesives spot applied on one or both of inside left and right panels 18, 20 near the peripheral edge thereof, and fasteners such as Velcro®, snaps, etc.

Figure 4:
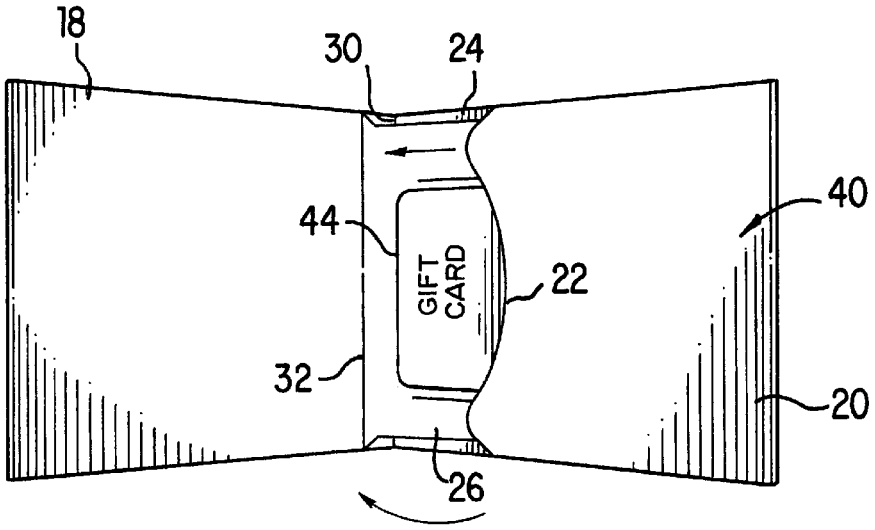
FIG. 4 is an exemplary message card of the present invention containing a transaction card in the holder thereof, as shown in a partially opened state.
Figure 5:
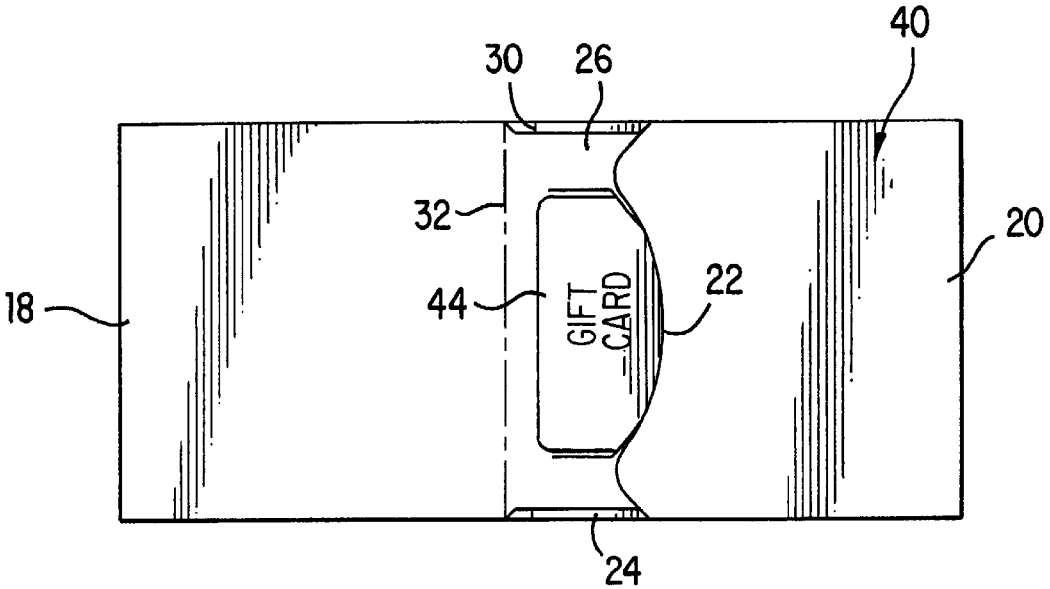
FIG. 5 illustrates the greeting card of FIG. 4 showing a transaction card displayed therein with the message card in a fully opened state.

FIG. 4 shows a message card 12 containing a transaction card 44 in a partially opened state. As the message card 12 is opened by rotating front panel 16 and inside left panel 18 about the axis of central fold line 30, the offset distance 42 of the interior fold line 32 from the central fold line 30 causes the transaction card panel 26 to slide partially out of pocket 40. The transaction card 44 thus "pops out" from behind the edge 22 of inside right panel 20 so that a significant portion of the transaction card 44 is displayed upon opening the card 12, as seen in FIG. 5. The movement of the transaction card 44 out of the pocket 40 as the message card 12 is opened provides an eye-catching effect and serves similarly to an "unwrapping" of the gift. In the illustrated embodiment, at least about half of the transaction card 44 extends outward and is exposed to the recipient or consumer when the message card is opened, although the exposed amount may be greater or lesser as desired by the manufacturer. This relationship is important because it provides the desired balance between providing a sufficient amount of the card 44 to be recognized, while keeping enough of the card 44 in the pocket 40 to provide stability. Similarly, upon closing the message card 12, the transaction card panel 26, and hence transaction card 44, slides back into pocket 40.

Transaction card 44 is preferably a credit-card sized card having a magnetic stripe, bar code, or other information storage medium on a surface thereof and/or an account number or other access information printed thereon or imprinted therein. Of course, the transaction cards 44 may be formed to have any size and shape desired, as long as the holder formed in transaction card panel 26 is formed accordingly to accommodate the transaction card 44.

In a preferred application of the invention, transaction card 44 may be a gift card to be given to a recipient in conjunction with a message card 12 embodied as a greeting card. As discussed above, the gift card may have a prepaid value, purchased by the sender, "stored" in the magnetic stripe, bar code or other storage medium, or associated with the account information provided on the card. The gift card thus provides access to a declining balance account, wherein the value is deducted based on purchases or use by the bearer of the card, and may be "refillable."

In another environment of use, the transaction card 44 may be used to promote, introduce, or encourage consumer patronage for a particular product, service, restaurant, brand, store, etc. Here, the content of the message card 12 corresponds specifically with the subject matter promoted by the transaction card 44. Examples of applications for transaction cards 44 include, but are not limited to, free minutes for a telecommunication service or internet access service, coupons or discounts for retail goods or services; and passwords for temporary or "free trial" access to a subscription service.

Message cards 12 embodied as such promotional items and the associated transaction cards 44 may be distributed to members of the public or selected target consumer groups through displays at public locations, insertions in newspapers, magazines, etc., or through mailings via the U.S. Postal Service, for example.

Figure 6:
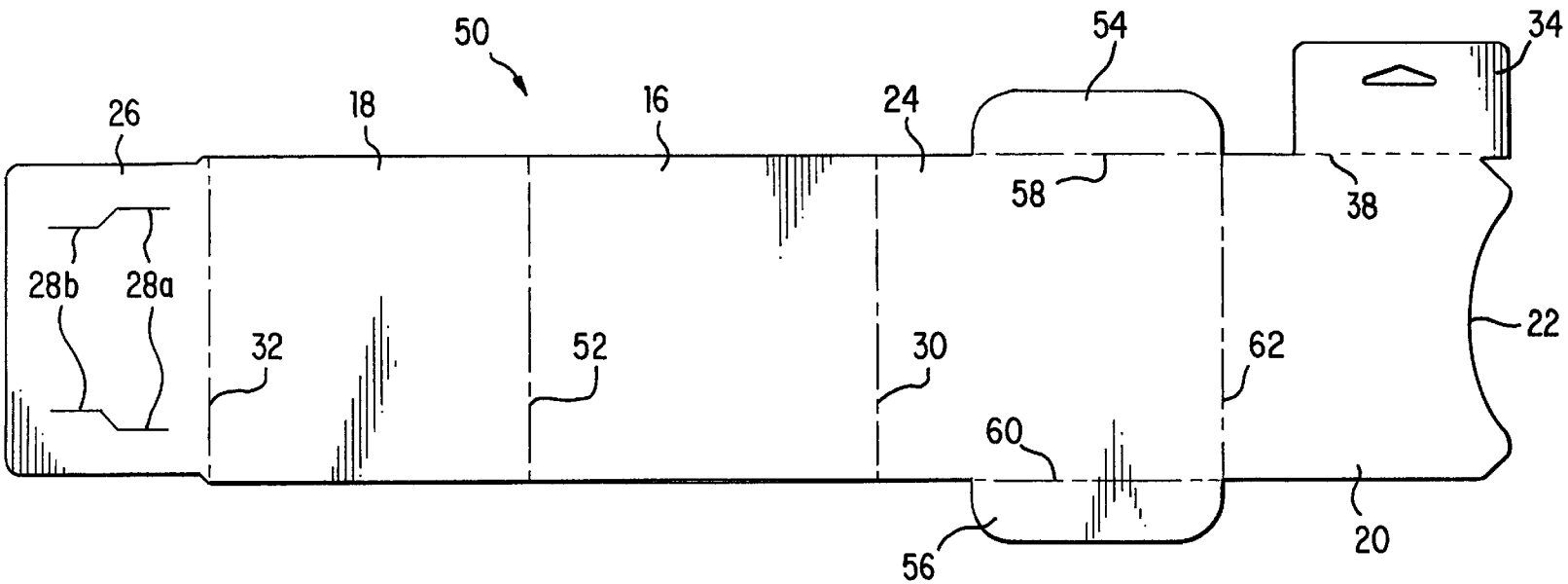
FIG. 6 shows an unassembled blank of the integrated message card and transaction card holder of the present invention.

Next, a description will be provided of the integrated message card and transaction card holder 10 of the present invention in an unassembled state, and a process for assembling the integrated message card and transaction card holder 10 from a blank 50, shown in FIG. 6.

Blank 50 is preferably made from a cardboard or paperboard material, such as those typically used for making greeting cards, or from a light plastic material, and includes transaction card panel 26 adjoining a first side of inside left panel 18 along interior fold line 32; a first side of front panel 16 adjoining a second side of inside left panel 18 along a front exterior fold line 52; a first side of rear panel 24 adjoining a second side of front panel 16 along central fold line 30; a first side of inside right panel 20 adjoining a second side of rear panel 24 along a rear exterior fold line 62; first and second flaps 54 and 56 adjoining third and fourth sides of rear panel 24, respectively, along first and second flap fold lines 58 and 60, respectively; and hangar tab 34 adjoining a second side of rear panel 24 along perforated line 38.

In this exemplary embodiment, transaction card panel 26, inside left panel 18, front panel 16, rear panel 24, and inside right panel 20 are arranged linearly, as seen in FIG. 6. With this configuration, only one side of the blank 50 needs to be printed to provide text, images, etc. on the viewable sides of all the panels of the assembled product. For example, with a linear configuration, the printed matter 15, 17 and 19 on panels 16, 18 and 20, respectively, can all be printed on the same side of the blank 50.

Other configurations are possible, however, and are within the scope of the present invention. For example, inside left panel 18 (and hence front exterior fold line 52) may be formed to adjoin front face panel 16 along either the top edge or the bottom edge of the latter, according to the orientation shown in the drawing, instead of along the left side thereof. With such an alternative configuration, transaction card panel 26 would adjoin inside left panel 18 along the right side of the latter, so as to be oriented properly upon assembly of the blank 50.

In another alternative configuration, inside right panel 20 may be formed to adjoin rear panel 24 along either the top edge or the bottom edge of the rear panel 24, according to the orientation shown in the drawing, instead of along the right side thereof. As such, one of first and second flaps 54, 56 would be formed to adjoin either rear panel 24 along the right edge thereof, as seen in the drawing, or inside right panel 20 along any available edge thereof, other than edge 22. Moreover, hangar tab 34 may be formed to adjoin any available edge of inside left panel 18, front panel 16, rear panel 24, or inside right panel 20 other than edge 22.

Further alternative configurations may be provided in which first and second flaps 58, 60 may be formed to adjoin any combination of edges among the top and bottom edges of rear panel 24 and inside right panel 20, according to the orientation shown in FIG. 6, and/or hangar tab 34 may be formed to adjoin an available upper or lower edge of any of panels 16, 18, 20, and 24. Further still, other combinations of the configurations described hereinabove may be used, as especially where the blank can be assembled into the integrated message card and transaction card holder 10 shown in FIG. 1, with the same functional aspects described above.

Figure 7:
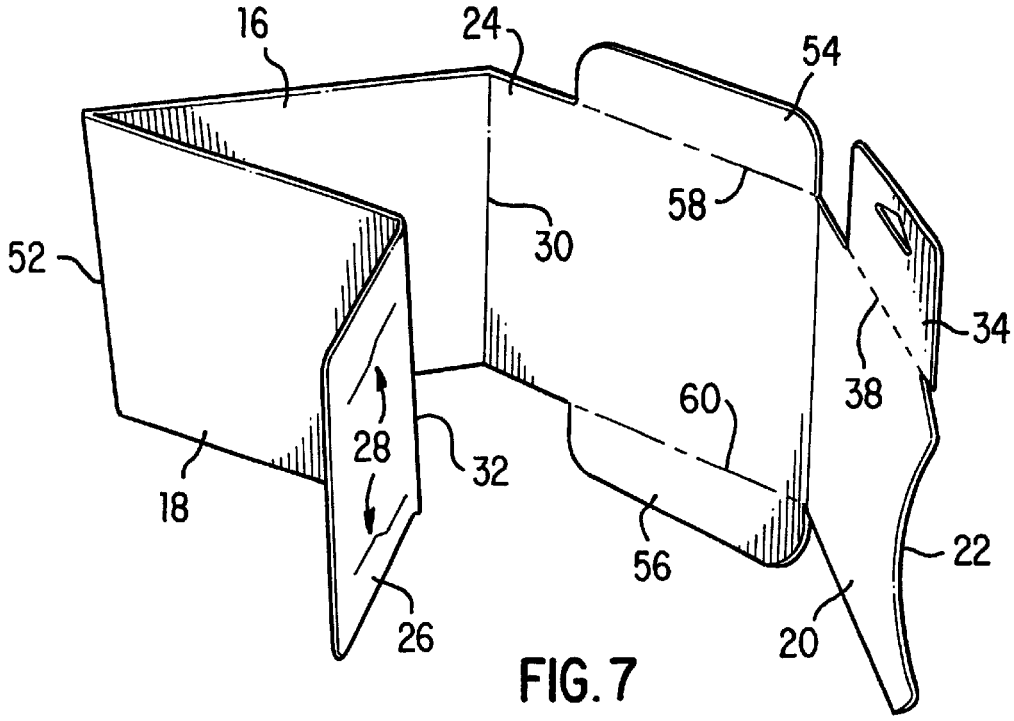
FIG. 7 illustrates a step in the process of assembling/folding the blank shown in FIG. 6 to obtain the integrated message card and transaction card holder shown in FIG. 1.
Figure 8:
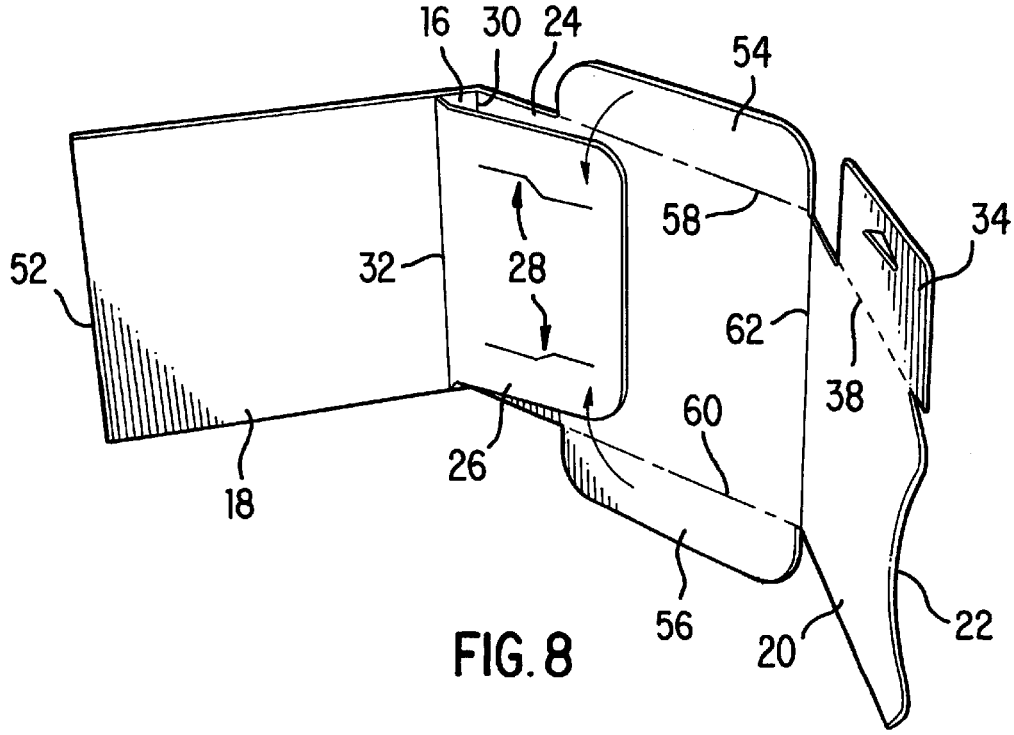
FIG. 8 illustrates a step in the process of assembling/folding the blank shown in FIG. 6 subsequent to the step illustrated in FIG. 7.

When starting with the blank 50 shown in FIG. 6, the integrated message card and transaction card holder 10 is formed by first folding along front exterior fold line 52 to bring inside left panel 18 into contact with front panel 16, as shown in FIG. 7. As seen in FIG. 8, inside left panel 18 and front panel 16 are aligned along the front exterior fold line 52, and their upper and lower edges. The right edge of front panel 16 corresponds with central fold line 30, and extends past the right edge of inside left panel 18, which corresponds with the interior fold line 32. Optionally, the two panels may be sealed together with an adhesive applied to one or both confronting surfaces of the two panels 16 and 18.

Figure 9:
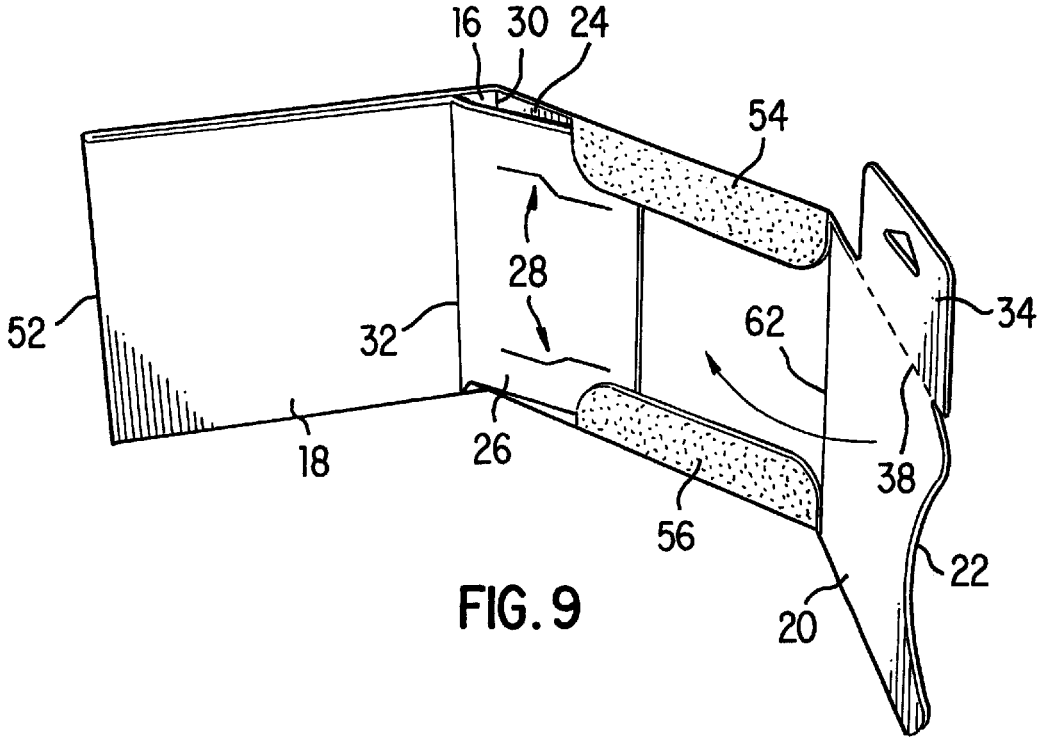
FIG. 9 illustrates a step in the process of assembling/folding the blank shown in FIG. 6 subsequent to the step illustrated in FIG. 8.

Next, with the transaction card panel 26 overlapped onto rear panel 24, flaps 54 and 56 are folded along flap fold lines 58 and 60, respectively, so as to overlap the corners of transaction card panel 26, as illustrated in FIGS. 8 and 9. An adhesive is then applied to the surfaces of flaps 54, 56 which face away from transaction card panel 26 (FIG. 9).

Figure 10:
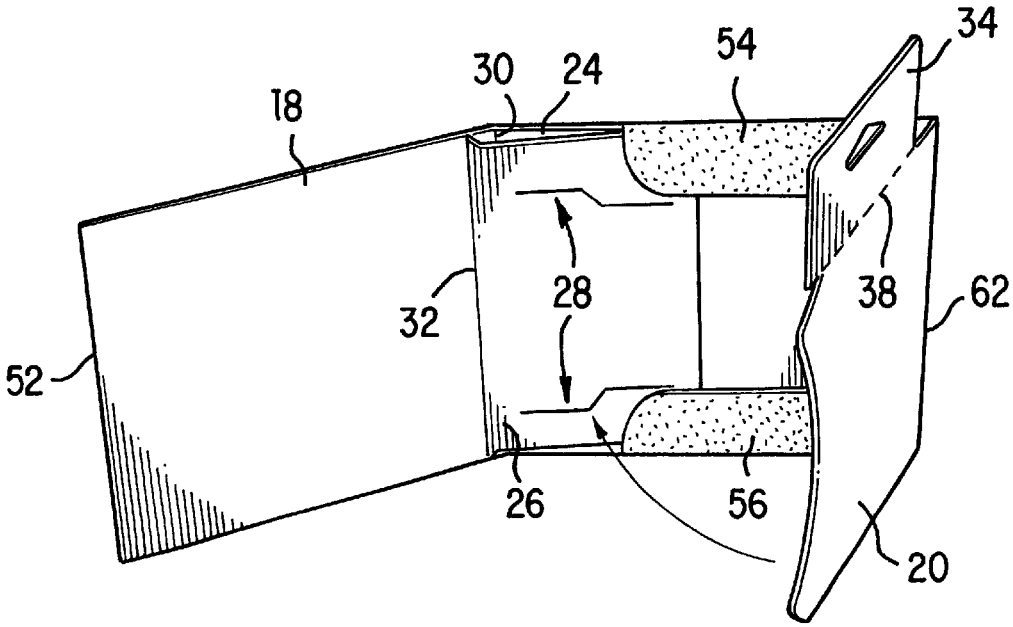
FIG. 10 illustrates a step in the process of assembling/folding the blank shown in FIG. 6 subsequent to the step illustrated in FIG. 9.

Inside right panel 20 is then folded toward transaction card panel 26 along rear exterior fold line 62, as shown in FIG. 10, and is secured in place upon contact with the adhesive-coated flaps 54 and 56, to thereby form pocket 40. Assembled in this manner, the blank 50 is transformed into the integrated message card and transaction card holder 10. Similar assembly operations are performed with the various alternative collapsed configurations to obtain similar integrated message card and transaction card holders in accordance with the present invention.

As mentioned above, transaction card panel 26 is smaller in height than adjoining inside left panel and rear panel 24 such that transaction card panel 26 appears to have been cut away along both its top and bottom edges thereof. Also, the width of transaction card panel 26 is substantially less than the width of rear panel 24, such that when the message card 12 is in a closed position, only approximately one-half of transaction card panel 26 is inserted behind the flaps 54 and 56, and edge 22 of pocket 40. The reduced height and width of the transaction card panel 26 allows the panel 26 to move with relative ease back and forth in the pocket 40 upon opening and closing the card 12, by reducing the potential for the edges of transaction card panel 26 being hindered by frictional resistance in the creases along fold lines 58 and 60.

Transaction card panel 26 is not necessarily permanently retained inside pocket 40 during the assembly of the invention. Optionally, pocket 40 may be formed while the transaction card panel 26 is positioned outside thereof, and may be later inserted into the pocket at the time a transaction card is to be placed in the holder 28. Similarly, depending on the dimensions of the transaction card panel 26 relative to the depth of pocket 40 as well as the ease of insertion of a transaction card into holder 28, the transaction card panel 26 may be removed from pocket 40 for inserting a transaction card therein, and then reinserted into the pocket thereafter. Removal of the transaction card panel 26 from the pocket 40 or providing an assembled message card and transaction card holder with the transaction card panel 26 outside the pocket 40, however, is more feasible when the dimensions of transaction card panel 26 are such that the transaction card panel 26 extends only shallowly into the pocket 40 when inserted therein.

Figure 11:
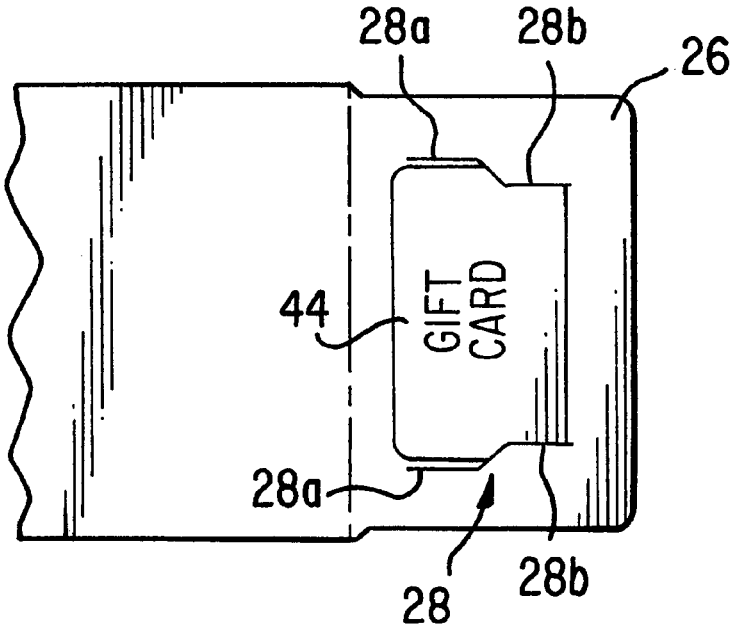
FIG. 11 illustrates a transaction card inserted into the transaction card holder shown in FIG. 1.

In the preferred embodiment, transaction card holder 28 is formed in transaction card panel 26 as a pair of slits die cut through the panel 26. As can be seen in FIG. 6, inter alia, the slits are formed as a pair of substantially parallel cuts having a portion 28*a* spaced apart to the same width as or slightly wider than the width of a standard credit card-sized transaction card, and then tapering together to a second parallel portion 28*b* which is spaced apart to a width narrower than the width of the transaction card. FIG. 11 shows a transaction card 44 inserted into the slits of holder 28, with the lower corners of the card 44 placed behind the narrower second portion 28*b*, and the remainder of the card 44 positioned on the front surface of panel 26. The transaction card crosses from being behind the transaction card panel 26 to being on the front surface of the panel 26 at the ends of the slits at portion 28*b*. Thus, transaction card 44 is prevented from slipping completely through the slits to fall behind the transaction card panel 26.

The slits forming holder 28 may be formed according to other shapes, as desired. For example, the holder may be formed as a pair of short diagonal cuts through which the bottom corners only of a transaction card 44 can be inserted. Alternatively, holder 28 may be formed as other embodiments entirely, such as a shallow pocket or transparent sleeve attached to the surface of transaction card panel 26.

In the exemplary embodiment described herein, the pocket 40 is formed at the right side of the opened message card. This is the preferred arrangement for a typical message card in which the front panel opens like a book toward the left, because it produces a dynamic effect which is more noticeable to the recipient or consumer when the message card is opened. However, the integrated message card and transaction card holder of the present invention also encompasses variations of the disclosed embodiment in which the pocket and transaction card holder is provided on the left side of the opened card. The present invention further encompasses message cards which open vertically, in which the pocket and transaction card holder is provided preferably in the upper portion, but alternatively in the lower portion of the opened card. Of course, for each of these variations, corresponding changes to the unassembled blank may be made, while still preserving the function of a "pop-out" display of a transaction card. Further still, although the embodiment discussed herein is shown in the drawings as a message card which is substantially square in shape, the message card may be formed to be of other shapes and sizes as designed, with the unassembled blank designed accordingly to be assembled in a similar manner and to function as described herein.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed as new and desired to be protected by Letters Patent of the United States is:

1. An integrated message card and transaction card holder, comprising:

a first exterior panel;

a second exterior panel having a width equal to that of said first exterior panel, a first side of said first exterior panel being connected to a first side of said second exterior panel along a central fold line;

a first interior panel having a first side thereof connected to a second side of one of the first exterior and second exterior panels, said first interior panel being additionally attached to said one of the first and second exterior panels along additional sides or peripheral edges of the latter, so as to form a pocket with said one of the first and second exterior panels;

a second interior panel connected along a first side thereof to the other of the first and second exterior panels along a second side thereof, said second interior panel having a width slightly less than that of said other of the first and second exterior panels, said second interior panel being overlaid onto said other of the first and second exterior panels so that when said first and second exterior panels are folded along said central fold line, said first interior panel faces said second interior panel; and a transaction card panel connected to a second side of said second interior panel along an interior fold line which is offset from said central fold line, wherein said transaction card panel is insertable into said pocket, is movable between a first position when the first and second exterior panels are disposed relative to each other in a closed position and a second position when the first and second exterior panels are disposed relative to each other in an open position, and includes a transaction card holder.

2. The integrated message card and transaction card holder according to claim 1, wherein the transaction card panel has a height which is less than that of the first and second exterior panels.

3. The integrated message card and transaction card holder according to claim 1, wherein the holder is formed by slits cut into the transaction card panel.

4. The integrated message card and transaction card holder according to claim 1, further comprising a hangar tab detachably formed along one side of any of the first or second exterior panels or of the first or second interior panels.

5. The integrated message card and transaction card holder according to claim 1, further comprising promotional content provided on at least one of said first exterior panel, said second exterior panel, said first interior panel, said second interior panel, and said transaction card panel.

6. The integrated message card and transaction card holder according to claim 1, further comprising greeting card content, including words and/or images pertaining to a special occasion, holiday, event or situation, provided on at least one of said first exterior panel, said second exterior panel, said first interior panel, said second interior panel, and said transaction card panel.

7. An integrated card package, comprising:

a message card which can be manipulated between an opened state and a closed state;

a transaction card holder integrally formed with said message card and including securing means, whereby a transaction card can be securely retained on said transaction card holder solely by said securing means;

a cover integrally formed with said message card for at least partially covering said transaction card holder, wherein said transaction card holder is movable between a first position when said message card is in the closed state and a second position when said message card is in the opened state, such that when a transaction card is secured on said transaction card holder, said transaction card holder is placed behind said cover and said message card is opened, the transaction card is displayed from behind said cover.

8. The package according to claim 7, wherein the message card contains commercial or promotional content.

9. The package according to claim 7, wherein the message card is a greeting card containing words and/or images pertaining to a special occasion, holiday, event or situation.

10. The package according to claim 7, wherein the cover is formed as a pocket, and wherein the transaction card holder is slidable in and out of said pocket.

11. The package according to claim 7, further comprising a detachable tab attached to said message card for mounting the package on a display device.

12. The package according to claim 7, wherein said securing means includes at least one slit cut into said transaction card holder such that a transaction card can be inserted into said at least one slit to securely hold the transaction card on said transaction card holder.

13. An integrated card package, comprising:

a front panel;

a rear panel connected to said front panel along a central fold line;

a transaction card holder connected to one of said front and rear panels at a location offset from said central fold line, said transaction card holder including securing means, whereby a transaction card can be securely retained on said transaction card holder solely by said securing means;

a cover provided on the other of said front and rear panels, said cover being sized and shaped to cover at least a portion of the other of said front and rear panels so that at least a portion of said transaction card holder is insertable behind said cover;

wherein said transaction card holder is moveable between a first position relative to said cover when said at least a portion of said transaction card holder is insertable behind said cover and said front panel is substantially superposed over said rear panel, and a second position relative to the cover when said at least a portion of said transaction card holder is insertable behind said cover and said front panel is substantially juxtaposed with said rear panel along said central fold line.

14. The integrated card package according to claim 13, wherein said transaction card holder is slidable between said first and second positions.

15. The integrated card package according to claim 13, wherein the cover forms a pocket with said other of said front and rear panels.

16. The integrated card package according to claim 13, wherein when a transaction card is placed into said transaction card holder, said transaction card is more exposed relative to said cover when said transaction card holder is in said second position than when said transaction card holder is in said in first position.

17. The integrated card package according to claim 13, further comprising a detachable tab attached to one of said front panel, said rear panel, and said cover.

18. The integrated card package according to claim 13, wherein at least the front panel contains commercial or promotional content.

19. The integrated card package according to claim 13, wherein at least the front panel contains greeting card content, including words and/or images pertaining to a special occasion, holiday, event or situation.

20. The package according to claim 13, wherein said securing means includes at least one slit cut into said transaction card holder such that a transaction card can be inserted into said at least one slit to securely hold the transaction card on said transaction card holder.

21. A blank to be assembled into a combined message card and transaction card holder, comprising a first exterior panel having a width extending from a central fold line in the blank to a first edge fold line in the blank;

a second exterior panel adjoining said first exterior panel along said central fold line and having a width equal to the width of said first exterior panel, the width of said second exterior panel extending from said central fold line to a second edge fold line in the blank;

a first inside panel adjoining said first exterior panel with one side thereof aligned with said first edge fold line, said first inside panel having a width less than that of said first exterior panel and extending from said first edge fold line to an interior fold line;

a transaction card panel adjoining said first inside panel along said interior fold line, said transaction card panel including a holder for holding a transaction card;

a second inside panel adjoining said second exterior panel with one side thereof aligned with said second edge fold line, said second inside panel having a width substantially less than that of said second exterior panel; and means for facilitating securement of said second inside panel to said second exterior panel so as to form a pocket for covering at least part of said transaction card panel.

22. The blank according to claim 21, wherein the means for facilitating securement comprises first and second flaps each adjoining one of said second exterior panel and said second inside panel.

23. The blank according to claim 21, further comprising a hangar tab detachably connected to any of said first exterior panel, second exterior panel, first inside panel, or second inside panel.

24. The blank according to claim 21, further comprising message content provided on at least one of said first exterior panel, said second exterior panel, said first inside panel, said second inside panel, and said transaction card panel.

25. The blank according to claim 24, wherein the message content is promotional or commercial content.

26. The blank according to claim 24, wherein the message content is greeting card content, including words and/or images pertaining to a special occasion, holiday, event or situation.

27. The blank according to claim 24, wherein said first exterior panel, said second exterior panel, said first inside panel, said second inside panel, and said transaction card panel are arranged in a configuration such that only one side of the blank is provided with said message content so as to be viewable on the relevant panel or panels when the blank is in an assembled state.

28. The blank according to claim 21, wherein the blank is configured such that said transaction card panel, said first inside panel, said first exterior panel, said second exterior panel, and said second inside panel are linearly and sequentially arranged in that order.

* * * * *